US007199765B2

(12) United States Patent
Chou et al.

(10) Patent No.: US 7,199,765 B2
(45) Date of Patent: Apr. 3, 2007

(54) MOBILE COMMUNICATION APPARATUS AND GLOBAL POSITIONING SYSTEM (GPS) ANTENNA THEREOF

(75) Inventors: Chien-Pang Chou, Shindian (TW); Yun-Ta Chen, Shindian (TW)

(73) Assignee: High Tech Computer Corp., Taoyuan (TW)

( * ) Notice: Subject to any disclaimer, the term of this patent is extended or adjusted under 35 U.S.C. 154(b) by 25 days.

(21) Appl. No.: 11/182,800

(22) Filed: Jul. 18, 2005

(65) Prior Publication Data

US 2006/0132365 A1 Jun. 22, 2006

(30) Foreign Application Priority Data

Dec. 16, 2004 (TW) ..... 93139231 A

(51) Int. Cl.
*H01Q 13/10* (2006.01)

(52) U.S. Cl. ..... 343/770; 343/702

(58) Field of Classification Search ..... 343/702, 343/700 MS, 846, 767, 770
See application file for complete search history.

(56) References Cited

U.S. PATENT DOCUMENTS

| | | | | |
|---|---|---|---|---|
| 5,361,061 | A * | 11/1994 | Mays et al. | 340/7.54 |
| 6,404,394 | B1 * | 6/2002 | Hill | 343/702 |
| 6,639,560 | B1 * | 10/2003 | Kadambi et al. | 343/700 MS |
| 6,778,139 | B2 * | 8/2004 | Suzuki et al. | 343/700 MS |
| 6,831,607 | B2 * | 12/2004 | Hebron et al. | 343/700 MS |
| 6,897,817 | B2 * | 5/2005 | Jo et al. | 343/702 |
| 6,967,620 | B2 * | 11/2005 | Ryken et al. | 343/700 MS |
| 2004/0070537 | A1 * | 4/2004 | Kadambi et al. | 343/700 MS |

* cited by examiner

*Primary Examiner*—Hoang V. Nguyen
(74) *Attorney, Agent, or Firm*—Rabin & Berdo, PC

(57) ABSTRACT

A mobile communication apparatus includes a printed circuit board (PCB) and a global positioning system (GPS) antenna. The GPS antenna is made of a metal sheet, and vertically inserted into the PCB.

36 Claims, 4 Drawing Sheets

MOBILE COMMUNICATION APPARATUS AND GLOBAL POSITIONING SYSTEM (GPS) ANTENNA THEREOF

This application claims the benefit of Taiwan application Serial No. 93139231, filed Dec. 16, 2004, the subject matter of which is incorporated herein by reference.

BACKGROUND OF THE INVENTION

1. Field of the Invention

The invention relates in general to a mobile communication apparatus and global positioning system (GPS) antenna thereof, and more particularly to a mobile communication system, which utilizes a small-scale metal sheet for the GPS antenna design, and GPS antenna thereof.

2. Description of the Related Art

FIG. 1 is a schematic structure diagram of a conventional mobile communication apparatus having a GPS chip antenna. Referring to FIG. 1, the mobile communication apparatus 100, such as a personal digital assistant (PDA), a PDA phone, a smart phone, or a mobile phone, includes a GPS chip antenna 110 and a printed circuit board (PCB) 120. The GPS chip antenna 110 is disposed in a GPS antenna design region 130 of the PCB 120. The specification of the design region 130 is generally 18 mm×3 mm. The GPS antenna includes a ceramics part 112 and an antenna body 114. The antenna body 114, a printed circuit disposed on the surface of the ceramics part 112, can miniaturize the antenna 110 by using the ceramics 112 of high dielectric constant and provide a GPS operational frequency of 1575 MHz. The GPS chip antenna 110 is for example, a Hitachi SMA-15011C1 small ceramic antenna for GPS.

However, the chip antenna 110 having ceramics material is very easily damaged and broken in a drop test, and the performance of the antenna body 114 in receiving signals will be reduced due to high dielectric constant of the ceramics part 112. In addition, because the antenna body 114 is mainly disposed in parallel with the PCB 120, the antenna body 114 is easily interfered by circuits and other antennas on the PCB 120, thereby influencing the performance of the antenna body 114 in receiving signals. Using ceramics material to design antenna structure also increases manufacturing cost.

SUMMARY OF THE INVENTION

It is therefore an object of the invention to provide a mobile communication apparatus and GPS antenna thereof. By designing a number of declined slots on a metal sheet as an antenna, the metal antenna can be miniaturized and configured in the above-mentioned GPS chip antenna design region. Moreover, the antenna surface is perpendicular to the PCB. Therefore, not only a better antenna radiation field can be generated but also the manufacturing cost of GSP antenna can be reduced.

The invention achieves the above-identified object by providing a GPS antenna disposed on a PCB of a mobile communication apparatus. The GPS antenna is made of a metal sheet, and the metal sheet includes a number of slots.

The invention achieves the above-identified object by providing a mobile communication apparatus including a PCB and a GPS antenna. The GPS antenna is made of a metal sheet for vertically inserting into the PCB.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1:
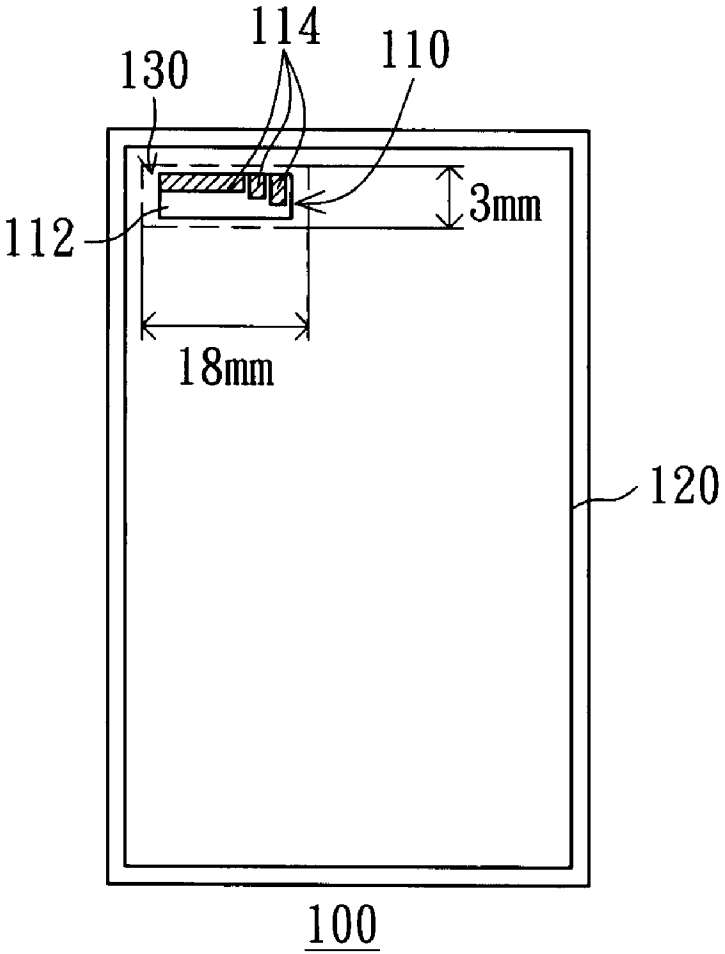
FIG. 1(PRIOR ART)
FIG. 1 is a schematic structure diagram of a conventional mobile communication apparatus having a GPS chip antenna.
Figure 2A:
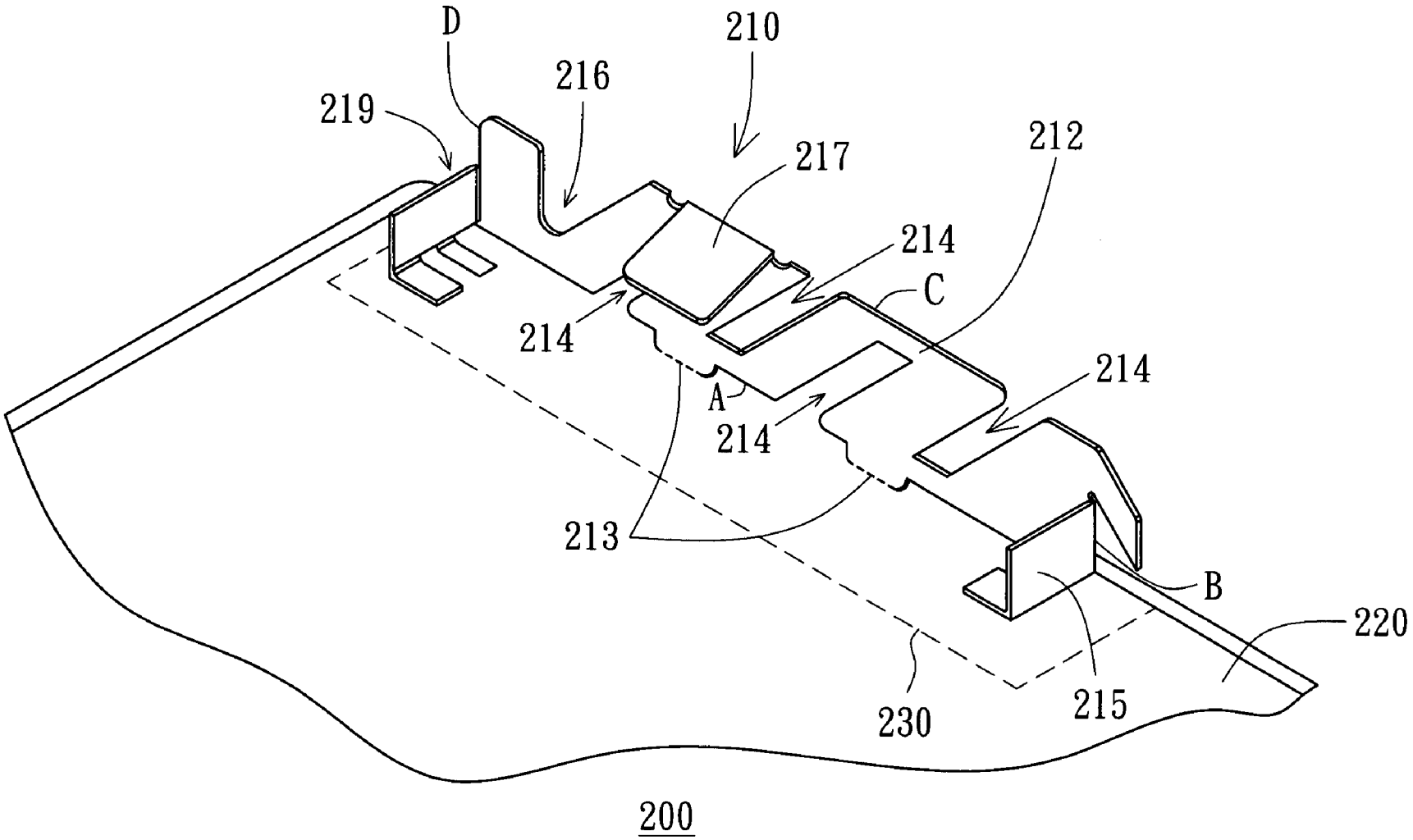
FIG. 2A is a schematic structure diagram of a mobile communication apparatus according to a preferred embodiment of the invention.
Figure 2B:
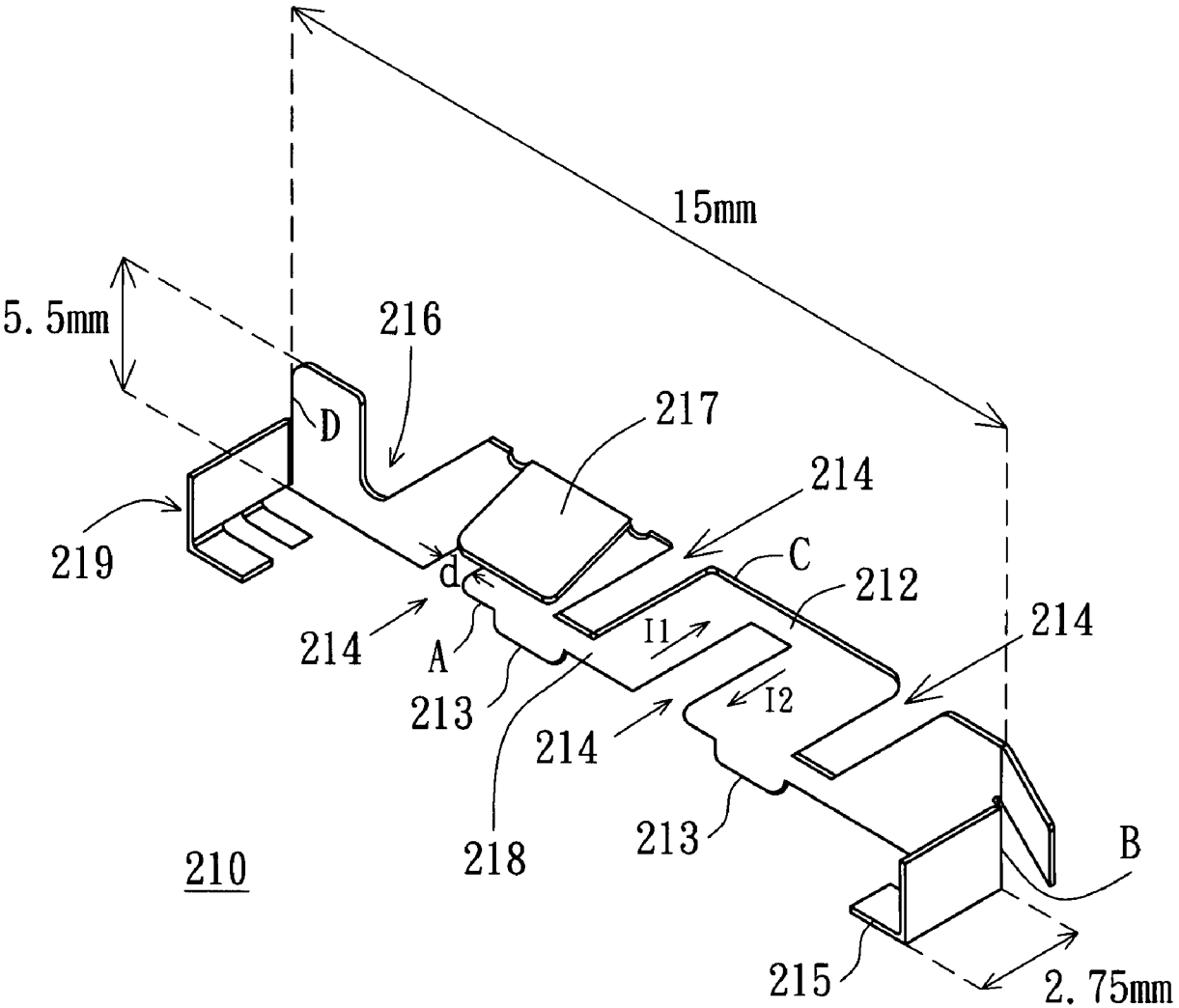
FIG. 2B is a structure diagram of a GPS antenna according to a preferred embodiment of the invention.

Referring to FIG. 2A and FIG. 2B simultaneously, a schematic structure diagram of a mobile communication apparatus and a structure diagram of a GPS antenna according to a preferred embodiment of the invention are shown. The mobile communication apparatus 200, such as a PDA, a PDA phone, a smart phone, or a mobile phone, includes a GPS antenna 210, a PCB 220, and other components (not shown in the figure). The GPS antenna 210 is disposed in the GPS antenna design region 230 of the PCB 220. The GPS antenna 210 includes a rectangle body 212, a positioning part 213, a support sheet 215, an adsorption sheet 217, and a feed-in part 219. The body 212 is for vertically inserting into the PCB 220. The metal sheet 212 further includes a number of declined slots 214 in parallel with each other and having the same slot width. The openings of two adjacent slots are formed in opposite direction.

The positioning part 213 is disposed at the bottom side A of the body 212. There are totally disposed two positioning parts in the preferred embodiment. The positioning part 213 is for inserting into the corresponding hole (not shown in the figure) of the PCB 220. The hole contains solder, and the solder is melt away to weld the positioning part 213 in the PCB 220 when a surface mount technology (SMT) is performed to weld the antenna 210 onto the PCB 220. The support sheet 215 is connected to a short side B of the body 212 without disposing any declined slots 214, for welding onto the PCB 220 and supporting the body 212 to be vertical with the PCB 220. In manufacturing process, the support sheet 215 can be welded onto the PCB 220 by SMT The adsorption sheet 217, connected to a top side C of the body 212, is disposed in parallel with the PCB 220 and vertical to the surface of the body 212. The SMT machine can mount the GPS antenna 210 on the PCB 220 by adsorbing the adsorption sheet 217. The feed-in part 219 is connected to a short side D of the metal sheet 212 opposite to the support sheet 215, for connecting with the PCB 220 and receiving GPS signals of operational frequencies. The feed-in part 219 is welded onto the PCB 220 by SMT.

As mentioned above, the GPS antenna design region 230 has a scale of 18 mm×3 mm. An ordinary metal antenna should have a length of 40 mm in order to generate resonance modes in a GPS operational frequency 1575 MHz. However, the GPS antenna having the body 212 structure of four declined slots 214 and one triangular slot 216 in the embodiment can be miniaturized and disposed in the design region 230, and generate resonance modes having the required GPS operational frequency in test.

As shown in FIG. 2B, the length of GPS antenna 210 is calculated about 15 mm with respect to the length of the body 212, and the width of GPS antenna 210 is determined to be about 2.75 mm according to the width of the support sheet 215. Therefore, the GPS antenna 210 can be disposed in the above-mentioned GPS antenna design region 230. In the embodiment, each declined slot 214 has an included angle about 30 degrees with respect to the short side D of the rectangle body 212 and the slot angle of the triangular slot 216 is also designed 30 degrees.

Besides, the slot width D of each declined slot 214 is about 0.8 mm. The induced currents 11 and 12 in opposite direction are respectively generated at two sides of the declined slot 214 after the antenna 210 receives a signal, so if the slot width of the declined slot 212 is too small, such as smaller than 0.8 mm, it will happen that the induced currents 11 and 12 are canceled out by each other.

The feed-in part 219 is disposed at the short side D of the body 212. When the antenna 210 receives a signal in a GPS operational band, the induced current can flow through the longest effective path, that is, from the short side D, pass the five turning parts 218 of the body 212 to the short side B. Although the total length of the rectangle body 212 is only 15 mm, resonance modes in a GPS operational band can be generated by smart design of the declined slots 214. In the invention, the triangular slot 216 is close to the short side D and the five turning parts 218 are formed respectively between two adjacent slots. The first turning part 218 is formed between the triangular slot 216 and the adjacent declined slot 214. The other four turning parts 218 are respectively formed between two adjacent declined slots 214.

The above-mentioned GPS antenna 210 can be designed a monopole antenna so as to improve performance in receiving signals. Moreover, the GPS antenna 210 can be a nickel silver material, or other materials having enough strength in order that the antenna 210 is not damaged in the drop test.

Figure 2C:
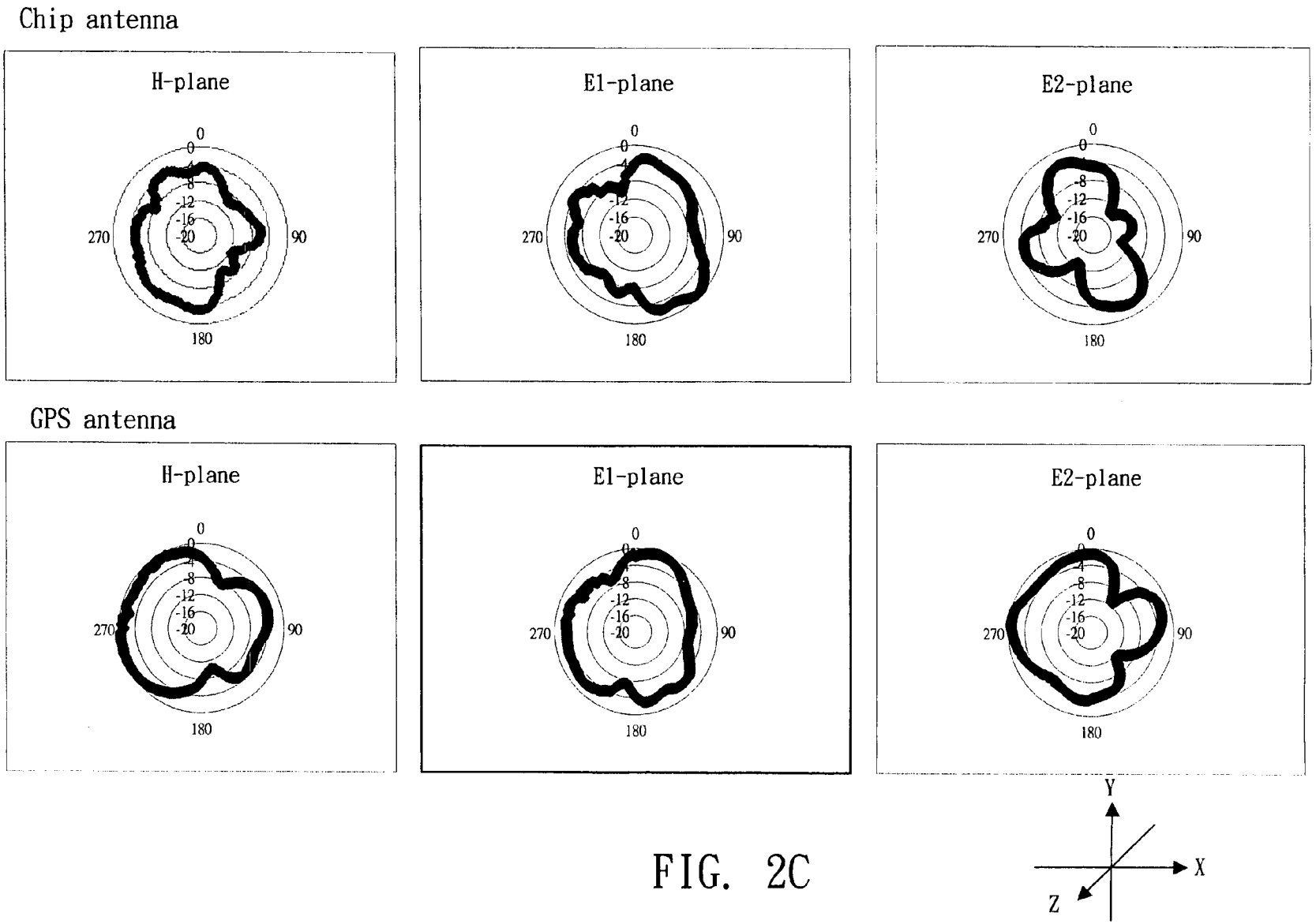
FIG. 2C is a comparison diagram between the radiation field of the conventional chip antenna and the radiation field of the GPS antenna of the invention in FIG. 2A.

Referring to FIG. 2C, a comparison diagram between the radiation field of the conventional chip antenna (a Hitachi SMA-15011C1 small ceramic antenna for GPS) 110 and the radiation field of the GPS antenna 210 of the invention in FIG. 2A is shown. The upper diagram of FIG. 2C shows the radiation fields generated by the conventional chip antenna 110 respectively on the H surface (i.e. the XZ-plane in the figure), the E1 surface (i.e. the YZ-plane in the figure), and the E2 surface (i.e. the XY-plane in the figure). The lower diagram of FIG. 2C shows the radiation fields generated by the GPS antenna 210 respectively on the H surface, the E1 surface, and the E2 surface. From FIG. 2C, the radiation field of GPS antenna 210 is closer to an ellipse polarization field than that of the chip antenna 110 in prior art. It implies that the small-scale metal antenna vertically disposed on the PCB 220 can really reduce the interference from circuits or other antennas on the PCB 220, and thus effectively improve the performance in receiving signals.

As described above, although the GPS antenna of the invention is exemplified to have a rectangle body composed of four declined slots and one triangular slot, the GPS antenna of the invention can also be any other metal sheet structure having slots. As long as the slot is suitably designed so that the antenna can be miniaturized and generate resonance modes in a GPS operational band, it will not be apart from the skill scope of the invention.

The mobile communication apparatus and GPS antenna thereof disclosed by the above-mentioned embodiment of the invention has the following advantages. The metal antenna having a rectangle body composed of several declined slots can be miniaturized and disposed in the design region for GPS chip antenna, and generate the required resonance modes in a GPS operational band. Therefore, the antenna of the invention can provide higher performance, and generate better ellipse polarization field. Furthermore, the antenna will not be damaged in the drop test and thus reduce manufacturing cost for its metal material has the features of high strength, easy production and low cost.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A global positioning system (GPS) antenna, disposed on a printed circuit board (PCB) of a mobile communication apparatus, comprising a metal sheet; and a rectangle body, wherein the metal sheet comprises a plurality of slots, and the rectangle body comprises a plurality of declined slots in parallel and having the same slot width, and openings of two adjacent declined slots are formed in opposite direction.

2. The GPS antenna according to claim 1, wherein the rectangle body has a length smaller that 18 mm and a height smaller than 6 mm.

3. The GPS antenna according to claim 2, wherein each of the declined slots has an included angle about 30 degrees with respect to a short side of the rectangle body.

4. The GPS antenna according to claim 3, wherein the slot width of each declined slot is not smaller than 0.8 mm.

5. The OPS antenna according to claim 1, further comprising a positioning part connected to a bottom side of the rectangle body for inserting into the PCB.

6. The GPS antenna according to claim 5, further comprising a support sheet, connected to a side of the rectangle body for welding onto the PCB, and supporting the GSP antenna to be vertical with the PCB.

7. The GPS antenna according to claim 6, further comprising an adsorption sheet, connected to a top side of the rectangle body, and vertical to the body, wherein a SMT machine can mount the GPS antenna on the PCB by adsorbing the adsorption sheet.

8. The GPS antenna according to claim 7, further comprising a feed-in part, connected to a side of the rectangle body opposite to the support sheet, for coupling with the PCB and receiving a signal in a GPS operational band.

9. The GPS antenna according to claim 1, wherein the GPS antenna is a monopole antenna.

10. The GPS antenna according to claim 1, wherein the GPS antenna is made of a nickel silver material.

11. A mobile communication apparatus comprising:

a printed circuit board (PCB): and a global positioning system (GPS) antenna, the antenna being made of a metal sheet, and being vertically inserted onto the PCB, wherein the GPS antenna comprises a rectangle body, the rectangle body comprising a plurality of declined slots in parallel and having the same slot width, and the openings of two adjacent declined slots are formed in opposite direction.

12. The mobile communication apparatus according to claim 11 wherein the GPS antenna is disposed in a region of the PCB having a length of 18 mm and a width of 3 mm.

13. The mobile communication apparatus according to claim 12 wherein each of the declined slots has an included angle about 30 degrees with respect to a short side of the rectangle body.

14. The mobile communication apparatus according to claim 13, wherein the slot width of each declined slot is not smaller than 0.8 mm.

15. The mobile communication apparatus according to claim 11, wherein the GPS antenna further comprises a positioning part, disposed at a bottom side of the rectangle body, for inserting into the PCB.

16. The mobile communication apparatus according to claim 15, wherein the GPS antenna further comprises a support sheet, connected to a side of the rectangle body, for welding onto the PCB and supporting the GPS antenna to be vertical with the PCB.

17. The mobile communication apparatus according to claim 16, wherein the GPS antenna further comprises a feed-in part, connected to a side of the rectangle body opposite to the support sheet, for coupling with the PCB and receiving a signal in a GPS operational band.

18. The mobile communication apparatus according to claim 17, wherein the GPS antenna further comprises an adsorption sheet, connected to a top side of the rectangle body, wherein a SMT machine can vertically mount the GPS antenna on the PCB by adsorbing the adsorption sheet.

19. The mobile communication apparatus according to claim 11, wherein the GPS antenna is a monopole antenna.

20. The mobile communication apparatus according to claim 11, wherein the GPS antenna is made of a nickel silver material.

21. The mobile communication apparatus according to claim 11, wherein the mobile communication apparatus is one of a personal digital assistant (PDA) and a PDA phone.

22. The mobile communication apparatus according to claim 11, wherein the mobile communication apparatus is one of a smart phone and a mobile phone.

23. An antenna for a global positioning system (GPS) made of a metal sheet, comprising:

a body comprising at least a slot;

a feed-in part connected to a first side of the body, for receiving a signal in a GPS operational band; and a support part, connected to a second side of the body, for welding onto a printed circuit board (PCB), further comprising an adsorption part connected to a third side of the body, wherein a surface mount technology (SMT) machine can mount the GPS antenna on the PCB by adsorbing the adsorption part.

24. The antenna for GPS according to claim 23, further comprising a positioning part, connected to a fourth side of the body, for inserting into the PCB.

25. The antenna for GPS according to claim 24, wherein the body has four declined slots and the openings of two adjacent slots are formed in opposite direction.

26. The antenna for GPS according to claim 25, further comprising a triangular slot close to the feed-in part.

27. The antenna for GPS according to claim 26, wherein the antenna can be disposed within a region having a length of 18 mm and a width of 3 mm.

28. The antenna for GPS according to claim 27, wherein each of the declined slots has an included angle 30 degrees with respect to the first side.

29. The antenna for GPS according to claim 28, wherein the antenna is made of nickel silver.

30. An antenna for GPS, made of a metal sheet, capable of being disposed in a region having a length of 18 mm and a width of 3 mm, wherein the antenna for GPS has a plurality of slots and an adsorption sheet, wherein openings of the slots are formed in different directions, and a surface mount technology (SMT) machine can adsorb the antenna via the adsorption part.

31. The antenna for GPS according to claim 30, wherein the slots are declined slots.

32. The antenna for GPS according to claim 31, wherein the slot width of each declined slot is not smaller than 0.8 mm.

33. The antenna for GPS according to claim 32, comprising a feed-in part and a support part, respectively located at two opposite sides of the antenna, wherein the feed-in part is for receiving a signal in a GPS operational band, and the support part is for tightly fixing the antenna onto a PCB.

34. The antenna for GPS according to claim 33, comprising a positioning part, for inserting into the PCB.

35. The antenna for GPS according to claim 34, comprising a triangular slot close to the feed-in part.

36. The antenna for GPS according to claim 35, capable of being disposed in a space having a height of 6 mm.

* * * * *